United States Patent [19]

Kirk

[11] 4,403,385

[45] Sep. 13, 1983

[54] PROCESS OF PREPARING A DOUBLE WALL HEAT EXCHANGER

[75] Inventor: Kenneth L. Kirk, Cranston, R.I.

[73] Assignee: Amtrol Inc., West Warwick, R.I.

[21] Appl. No.: 281,069

[22] Filed: Jul. 7, 1981

Related U.S. Application Data

[62] Division of Ser. No. 200,598, Oct. 24, 1980, Pat. No. 4,337,824.

[51] Int. Cl.[3] ..... B23P 15/26

[52] U.S. Cl. ..... 29/157.3 AH; 70/184; 70/70; 138/104; 285/13; 29/508; 29/507

[58] Field of Search ..... 29/157.4, 157.3 AH, 29/157.3 R, 505, 508, 516, 507, 515; 228/183, 184; 285/13; 165/70, 183, 184; 62/52; 138/148, 104, 173, 172

[56] References Cited

U.S. PATENT DOCUMENTS 2,586,653 2/1952 Hill ..... 29/157.3 AH
3,878,593 4/1975 Owen ..... 29/157.3 A

FOREIGN PATENT DOCUMENTS 2803365 7/1978 Fed. Rep. of Germany ..... 29/157.3 A

*Primary Examiner*—Francis S. Husar

*Assistant Examiner*—V. K. Rising

*Attorney, Agent, or Firm*—Fisher, Christen & Sabol

[57] ABSTRACT

A process for forming a double wall heat exchanger. A first ductile tube is placed inside of a second ductile tube. The first tube tightly fitting inside of the second tube. The first tube is the inner tube and the second tube is the outer tube. The combination of the outer tube and the inner tube is finned in a finning apparatus. A helical fin is pressure formed on the outer surface of the outer tube and simultaneously a small helical groove is formed on the inside surface of the outer tube which follows the path of the helical path of the helical fin. The internal pressure being applied to the inner tube causes the inner tube to expand and conform to the inside surface and diameter of the outer tube, with a continuous helical protrusion forming which mates with the internal helical groove of the outer tube, but not entirely filling the internal groove. A helical passageway between the inner and outer tubes is thereby formed. Preferably the inner and outer tubes are made of copper. Also preparably the inner and outer tubes, after being combined and before the rolling step, are annealed in a furnace. The production process provides reduced cost of manufacture, improved heat transfer and the safety feature required by the various state and local codes.

4 Claims, 5 Drawing Figures

O.D.
R
X
Y 10
12
14
16
18
20
22
42
44
52
54
56
58
60
62
64
66
68
A
B
C
D
E
F
G
H
I
J
K
L
M
N

PROCESS OF PREPARING A DOUBLE WALL HEAT EXCHANGER

This is a division of application Ser. No. 200,598, filed Oct. 24, 1980 and now U.S. Pat. No. 4,337,824 issued July 6, 1982.

BACKGROUND OF THIS INVENTION

1. Field of This Invention

This invention relates to double wall heat exchangers and methods of preparing such double wall heat exchangers.

2. Prior Art

Due to the possible toxicity of solar fluids, several codes of state and local governments have been enacted which require the heat exchanger tube coil to have two separate walls. The design of such double wall heat exchangers can be of two basic types, namely, vented and unvented. With the vented design, a failure of the inner coil will cause leakage at the terminal ends of the coil at a specified pressure (about 10 psig) between the tubes. With the unvented design, the terminal ends of the coil are sealed. The placing of one tube inside of another has been done in the past; however, in such cases, there is little or no metal contact surface between the tube walls resulting in poor heat transfer. The art has tried more elaborate schemes which have also been unsatisfactory.

U.S. Pat. No. 2,586,653 (Hill) produces a composite tube which has an outer tube with a helical outer fin. A matching internal helical groove is present on the outer tube. An inner tube has a helical outer rib that mates with the internal helical groove of the outer tube. There is no space between the inner tube and the outer tube (including the mating groove and rib) after they are formed. Hill forms the composite tube by using an outer tube that has a slightly larger inner diameter than the outer diameter of the inner tube. (A mandrel is usually inserted into the inner tube.) The mating rib of the inner tube is rolled up at the same time the material of the outer rib is extruded to form the mating fin. The mating rib of the inner tube is caused by the rolling pressure which formed the ribs of the outer tube. The outer tube is reduced in internal diameter and brought in complete contact with the inner tube.

In U.S. Pat. No. 3,750,444 (Bittner) in FIG. 3 shows an externally helically finned outer tube 1 and internally helically finned inner tube 3. The helical fins (ribs) have mating paths. The result is a helical passageway between the inner and outer tubes. The internal fins should cause quite a fluid flow pressure drop, etc.

FIG. 2 of U.S. Pat. No. 3,730,229 (D'Onofrio) shows an outer tube having internal helical grooves and an inner tube having mating internal helical grooves, the external protrusions of which fit in the helical grooves of the outer tube. Helical pathways are thereby formed between the inner and outer tubes. The inner helical tube is formed by twisting—see FIGS. 5 to 9. The internal helical groove of the outer tube is formed by deformation pressure when the internal helical tube is formed—see col. 4, lines 47 to 60. U.S. Pat. No. 4,111,402 (Barbini) shows two tubes, one inside of the other, which each have at least one spiral corrugation (fin) in opposite twist to the other. The spherical corrugations are each formed by the twist method. U.S. Pat. No. 2,913,009 (Kuthe) shrinks an outer tube around an inner helical tube. U.S. Pat. No. 2,724,979 (Cross) shows an inner tube inside of an outer helical tube.

U.S. Pat. No. 3,724,537 (Johnson) involves expanding an inner tube into the internal grooves of an outer finned tube by means of internal in-situ high pressure. The internal grooves of the outer tube are completely filled. U.S. Pat. No. 3,467,180 (Pensotti) shows an outer finned tube which has a series of internal longitudinal grooves. An inner tube is expanded into the longitudinal grooves. Pensotti also expands an inner tube having a series of external grooves against the smooth interior wall of the outer tube—a series of longitudinal passageways result. U.S. Pat. No. 4,031,602 (Cunningham et al.) teaches a method of making finned heat transfer tubes. U.S. Pat. Nos. 3,267,563 (Keyes I), 3,267,564 (Keyes II) show an internally finned tube telescoped in outer tube.

See also U.S. Pat. Nos. 3,887,004, 3,868,754, 3,878,593, 3,100,930, 3,267,563, 3,267,564, 2,693,026, 4,031,602, 1,970,481, 1,646,384 and 1,813,096.

BROAD DESCRIPTION OF THIS INVENTION

An object of this invention is to provide a double wall heat exchanger which has a helical passageway between the inner tube and outer tube thereof. Another object of this invention is to provide a double wall heat exchanger which has excellent heat transfer between the inner tube and outer tube thereof. A further object of this invention is to provide a double wall heat exchanger which has a path of leakage between the tubes at a pressure differential of 10 p.s.i.g. Another object of this invention is to provide a process for the preparation of such double wall heat exchangers, such process having reduced cost of manufacture. Other objects and advantages of this invention are set out herein or are obvious herefrom to one ordinarily skilled in the art.

The objects and advantages of this invention are achieved by the double wall heat exchanger and processes of this invention.

This invention includes a double wall heat exchanger for solar heaters and the like. The heat exchanger includes an outer tube having an outer helical fin and a small helical groove on the inside of the outer tube. The helical groove follows the helical path of the outer helical fin. There is an inner tube having a slightly-raised continuous helical protrusion which matches the path of the inner helical groove of the outer tube. A narrow helical passageway between the inner tube and outer tube is formed by the mating small helical groove and the slightly-raised continuous helical protrusion. The inner surface of the outer tube, except in the region of the inner small helical groove thereof, contacts the outer surface of the inner tube, except in the region of the slightly-raised continuous helical protrusion.

There is excellent heat exchange between the inner and outer tubes of this invention. The double wall heat exchanger has at least 98 percent metal-to-metal surface contact between the inner and outer tubes.

The helical continuous passageway between the inner and outer tubes typically has a height of 0.002 to 0.003 inch. The height of the helical passageway can be varied by the amount of prior annealing of the inner tube (or by using a softer metal for the inner tube). The more the prior annealing, the more the height of the passageway. The helical passageway takes up 2 percent or less of the surface area of the outer surface of the inner tube (or of the outer tube). If the percentage is more than 2 percent, heat transfer capicity is lost—dead air space means poor heat transfer. Typically the helical passageway has the following cross-section: ⅄. The size of the channel can be varied by varying the clearance between the inner and outer tubes. A tighter clearance means a smaller sized channel.

Preferably the double wall heat exchanger is prepared from previously annealed copper. Any other suitable materials can be used—any metal can be rolled to form the fins, etc., as long as the rolls are harder than the rolled material particularily the outer tube. For example, double wall heat exchangers for nuclear reactors can be prepared using a copper outer tube and a stainless steel inner tube. The inner and outer tubes can be made of the same or different metals provided the metal or metals are ductible enough to be rolled or finned.

The double wall heat exchangers of this invention preferably exclude internal fins since such internal fins cause a major fluid flow pressure drop, etc., in the passageway of the inner tube.

The process of this invention for preparing the double wall heat exchanger broadly includes placing an outer tube of predetermined thickness and inside diameter over a second tube also of a predetermined thickness and outside diameter. The material of the tubes is preferably drawn copper, but other materials can be used. The tubes are then placed in a furnace and annealed for a specified time and temperature. The double wall tubes are placed in a finning machine with a mandrel inside of the inner tube. Under a specified pressure and at a specified feed rate, integral fins are formed on the outside tube. While the fins are being formed on the outside tube, internal pressure is being applied forcing the inner tube to expand and conform to the inside diameter of the outer tube. The mating surfaces form a helical passageway which serves as the leakage path. Each set of roller dies is set at a slight canted angle (such as, two degrees, fifteen minutes)—that is well known procedure in the art.

A mandrel is normally inserted into the internal passageway of the inner tube during the rolling or finning step.

The double wall heat exchanger can be formed into coils having a diameter as small as three inches.

The outer tube has a slightly larger inner diameter than the outer diameter of the inner tube so that the inner tube can be inserted into the outer tube. The difference in such diameters is usually in the range of say 0.007 to 0.010 inches. The main factors are that the inner tube can easily be inserted into the outer tube without there being much play between the inner and outer tubes. During rolling the inner tube is expanded by the applied internal pressure to conform to the shape and inner diameter of the outer tube (the internal helical tube thereof is not completely filled by the expanding inner tube).

The continuous helical passageway (i.e., annular space) between the inner tube and the outer tube is helically shaped. The helical passageway (or spiral groove) can be vented (i.e., open on one or both ends) or unvented (i.e., closed on both ends). The helical passageway provides a path of leakage between the tubes at a pressure differential of 10 psig. This means that if the inner tube ruptures or developes a leak, there is a passageway to drain off the leaking internal fluid to a safe collection point without the internal fluid mixing with the external fluid (e.g., household bath and drinking water).

The process of this invention involves rolling to form the fins, etc., and does not involve forming the fins by the technique of twisting the tube.

DETAILED DESCRIPTION OF THIS INVENTION

Figure 1:
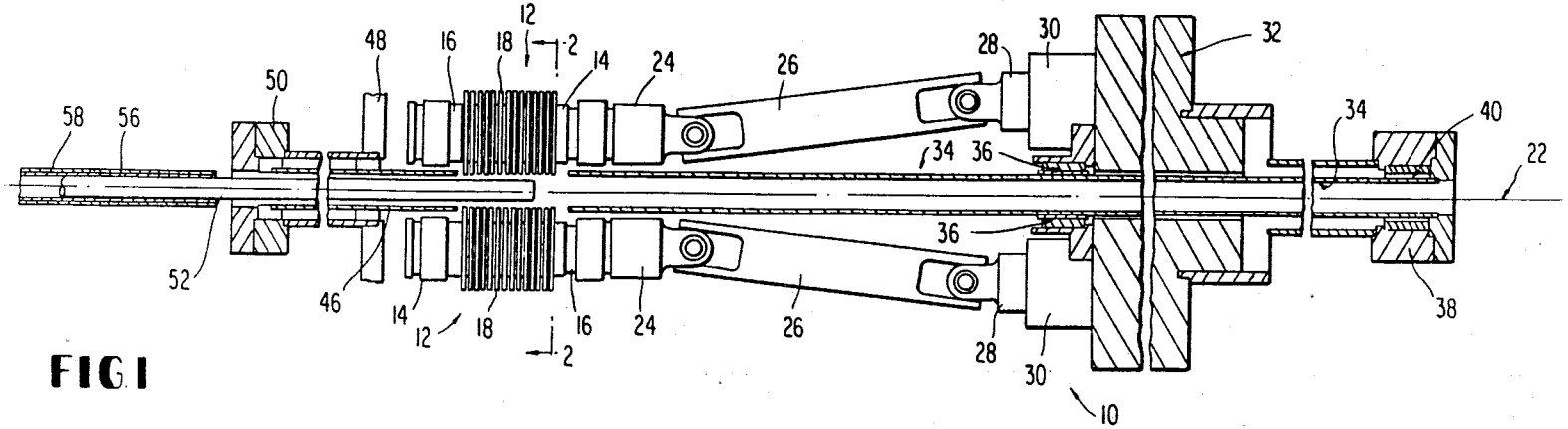
FIG. 1 is a partially cutaway, schematic, side elevational view of the equipment for carrying out the process of this invention for forming the double wall heat exchanger of this invention.
Figure 2:
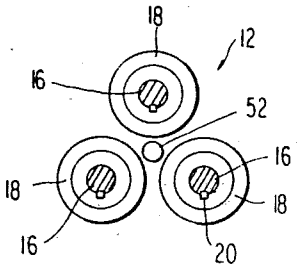
FIG. 2 is a sectional view along line 2—2 in FIG. 1 of the forming discs and the mandrel.
Figures 4, 5:
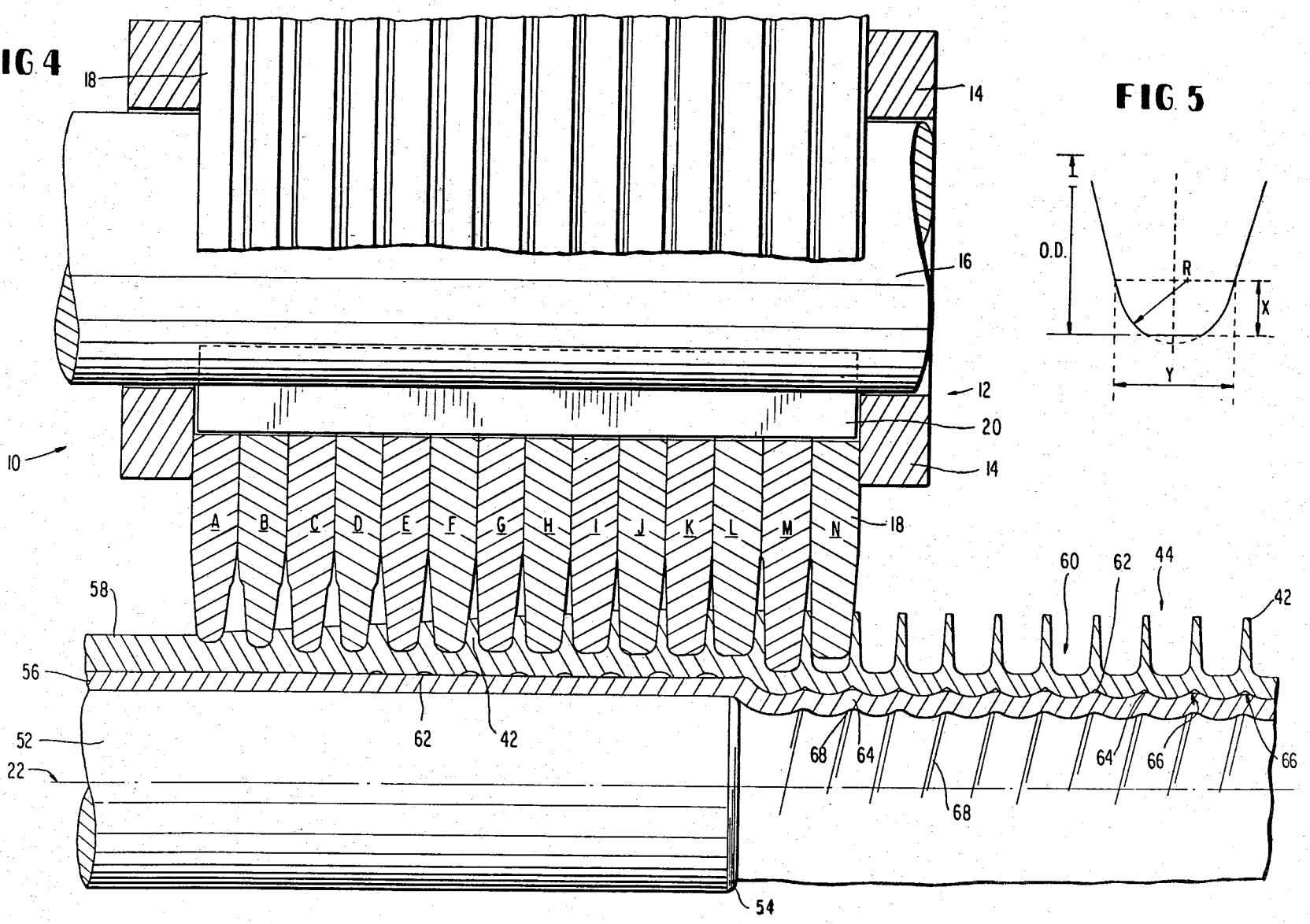
FIG. 4 is a partially cutaway side elevational view of the double wall heat exchanger being formed.
FIG. 5 is a profile view of roller dies A to D, but is also representive of the other roller dies.

In FIG. 1, numeral 10 is a rib-forming apparatus which uses a set of three roller die assemblies 12. (Rib-forming apparatus 10 can typically be a Reed cylindrical die thread rolling machine where the die is a set of three roller die assemblies 12. Any other suitable thread rolling or rib forming machine can be used.) Each roller die assembly 12 includes double-support die holder body 14, rod 16, and roller dies 18 mounted on rod 16. Rod 16 is rotatably mounted in die holder body 14 as best shown in FIG. 4. Key pin 20 holds roller dies 18 in place on rod 16. The three roller die assemblies 12 are mounted so as to be spaced about 120° apart around central axis 22.

Each Y-mounting 24 located on the end of a rod 16, forms a universal joint with a universal joint connector 26. A Y-mounting 28, located on the rotatable shaft of a drive means 30, forms a universal joint with a universal joint connector 26. Housing 32 contains central passageway in which is located near guide tube 34. Anti-friction bearings 36 are located around rear guide tube 34 and are mounted in the front end of housing 32. FIG. 1 shows extension support 38 which is used when long double wall heat exchangers are formed. Anti-friction bearings 40 are located around rear guide tube 34 and are mounted in extension support 38. The longitudinal axis of rear guide tube 34 coincides with central axis 22. Rear guide tube 34 extends almost to the outermost roller die 18 (i.e., roller die N), but far enough away therefrom so as not to interfer with the formation of fins 42 of double wall heat exchanger 44. Front guide tube 46 is mounted in back housing 48. The longitudinal axis of front guide tube 46 coincides with central axis 22. Rear guide tube 46 extends almost to the innermost roller die 18 (i.e., roller die A), but far enough away therefrom so as not to interfer with the operation of roller dies 18. FIG. 1 shows extension support 50 which is used when long tubing is fed into rib-forming apparatus 10. The front end of rear guide tube 46 is mounted in extension support 50.

Each roller die assembly 12 contains fourteen roller dies 18 (i.e., roller dies A to N). Each successive roller die A to C is longer. Roller dies C to L are of the same length, with roller die M being longer and roller die N being slightly shorter.

Mandrel 52 extends through front guide tube 46. The end of mandrel 52 is rounded or bevelled (54). The end of mandrel 52 before the bevel extends between roller die assemblies 12 as far as the approximate middle of roller die L. Inner tube 56 fits over mandrel 52 and is slidable thereover mandrel 52. Outer tube 58 tightly fits over inner tube 56. The longitudinal axis of each of mandrel 52, inner tube 56 and outer tube 58 coincides with central axis 22.

Figure 3:
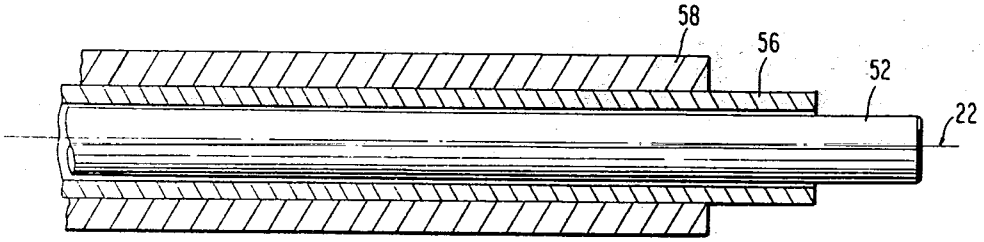
FIG. 3 is a side cross-sectional view of the inner tube inserted in the outer tube in place on the mandrel.

In a typical embodiment, as shown in FIGS. 3 to 5, outer tube 58 has an inside diameter of 0.604 inch and a wall thickness of 0.068 inch. Inner tube 56 has a wall thickness of 0.030 inch. The diameter of mandrel 52 is about 0.570 inch, leaving a clearance between mandrel 52 and inner tube 56 of about 0.004 inch. The following data identifies roller dies 18:

| Roller Die | Overall Diameter, Inch | Vertical Wall Slope[1], degrees | X[2], Inch | R[3] Inch | Y[4], Inch |
|---|---|---|---|---|---|
| A | 2.725 | 12½ | 0.023 | 0.025 | 0.043 |
| B | 2.735 | 12½ | 0.021 | 0.025 | 0.040 |
| C | 2.750 | 12½ | 0.021 | 0.025 | 0.040 |
| D | 2.750 | 11½ | 0.022 | 0.025 | 0.042 |
| E | 2.750 | 10½ | 0.025 | 0.025 | 0.051 |
| F | 2.750 | 9½ | 0.025 | 0.025 | 0.054 |
| G | 2.750 | 8½ | 0.025 | 0.025 | 0.057 |
| H | 2.750 | 7½ | 0.025 | 0.025 | 0.060 |
| I | 2.750 | 7 | 0.025 | 0.025 | 0.062 |
| J | 2.750 | 6 | 0.025 | 0.025 | 0.065 |
| K | 2.750 | 5 | 0.025 | 0.025 | 0.068 |
| L | 2.750 | 5 | 0.025 | 0.025 | 0.068 |
| M | 2.810 | 5 | 0.025 | 0.025 | 0.067 |
| N | 2.743 | 5 | 0.025 | 0.025 | 0.067 |

Notes:
[1]The vertical wall slope measures the angle from the vertical for each lower side of the particular roller die.
[2]X is the distance from the pivot points of the two Rs for each roller die to the horizontal cut off section of the bottom of each roller die. See FIG. 5.
[3]R is a radius of 0.025 inch in all cases, i.e., for all of the roller dies. Each bottom edge of each roller die has a radius R. FIG. 5 is a profile view of roller dies A to D, but is also applicable to roller dies E to N. For roller dies E to N, each of the two Rs are further apart from each oie thereby giving such roller dies blunter ends. For details, see FIG. 4.
[4]Y is the horizontal distance from side to side of each roller die at the height of line on which are located the pivot points for the arcs made by the Rs (i.e., a line of centers for the Rs). See FIG. 5.

All of roller dies 18 have a keyway depth of 3/32 inch. All of roller dies 18 are symmetric except for roller dies A, M and N—their asymmetric shapes are shown in FIG. 4. Each roller die has a thickness of 0.085 inch.

As outer tube 58 advances the successive roller dies 18 push deeper groove (60) in the outer surface thereof and fins (42) begins to form therebetween. See FIG. 4. As fin 42 is forming, small continuous helical groove 62 starts to form under fin 42—see between roller dies D and E in FIG. 4. As the end of mandrel 52 is passed, longer roller die M forces inner tube 56 and the main web of outer tube 58 downwards. (The edge of mandrel 52 is rounded having a radius of 0.010 inches.) Outer groove 60 becomes deeper giving fin 42 a height of 0.110 inch (with a top thickness of 0.010 inch and a bottom thickness of 0.022 inch). The top of fins 42 stays at the same level as and after inner tube 56 and outer tube 58 exit off of mandrel 52. The width of each groove 60 ends up being 0.067 inch.

As inner tube 56 exits off of mandrel 52, internal pressure forces it to conform to the shape and diameter of the bottom surface of outer tube 58. The surface contact between inner tube and outer tube 58 is 98 percent. Continuous helical protrusion 64 in the top of inner tube 56 forms. Continuous helical protrusion 64 moves into but does not completely fill, inner helical groove 62 of outer tube 58. Helical protrusion 64 follows the path of helical groove 62. Thereby continuous helical passageway 66 (annular space) forms between inner tube 56 and outer tube 58. Helical passageway has a height of 0.002 to 0.003 inch. (Inner helical groove 68 is also formed on inner tube 58 which follows the path of helical protrusion 64, but it presents a fairly smooth surface which causes little fluid flow pressure lose.)

The copper inner tube 56 and copper outer tube 58 were annealed at 1200° F. for 1½ hour. Roller dies 18 were cam driven and exerted pressures of greater than 500 to 1000 p.s.i. on the outer tube 58 and inner tube 56 during rolling. All of roller dies 18 have a cant angle of 2 degrees 15 minutes.

What is claimed is:

1. Process for forming a double wall heat exchanger which comprises:

(i) placing a first ductile tube inside of a second ductile tube, the first tube tightly fitting inside of said second tube, the first tube being the inner tube and the second tube being the outer tube, and placing a mandrel inside of the first ductile tube; and (ii) finning the combination of the outer tube and the inner tube and the inner tube in a finning apparatus, whereby a helical fin is pressure formed on the outer surface of the outer tube before the pipes reach the end of the mandrel and whereby simultaneously a continuous, small helical groove is formed on the inside surface of the outer tube which follows the path of the helical path of the helical fin, a disc of the finning apparatus, which is located beyond the end of the mandrel and which is larger in radius than the discs located over the mandrel, pushing inwardly both of the tubes after the tubes have progressed beyond the end of the mandrel, the radius of such disc being sufficiently large to provide sufficient inward pushing on the inner tube to cause the inner tube to expand and conform to the inside surface and diameter of the outer tube, whereby a slightly-raised, continuous, helical protrusion is formed which mates with the internal helical groove of the outer tube, but does not entirely fill the internal groove, a continuous helical passageway between the inner and outer tubes thereby being formed, the continuous, narrow helical passageway being unimpeded and extending from one end of the double wall heat exchanger to the other end thereof, the inner surface of the outer tube, except in the region of the inner, continuous, small helical groove thereof, contacting the outer surface of the inner tube, except in the region of the slightly-raised continuous helical protrusion thereof.

2. Process as claimed in claim 1 further comprising annealing the inner and outer tube, after being combined and before the rolling step.

3. Process for forming double wall tubing which consists of:

(i) placing a first ductile tube inside of a second ductile tube, the first tube tightly fitting inside of the second tube, the first tube being the inner tube and the second tube being the outer tube, and placing a mandrel inside of the first ductile tube; and (ii) finning the combination of the outer tube and the inner tube in a finning apparatus, whereby a helical fin is pressure formed on the outer surface of the outer tube before the pipes reach the end of the mandrel and whereby simultaneously a continuous, small helical groove is formed on the inside surface of the outer tube which follows the path of the helical path of the helical fin, a disc of the finning apparatus, which is located beyond the end of the mandrel and which is larger in radius than the disc located over the mandrel, pushing inwardly both of the tubes after the tubes have progressed beyond the end of the mandrel, the radius of such disc being sufficiently large to provide sufficient inward pushing on the inner tube to cause the inner tube to expand and conform to the inside surface and diameter of the outer tube, whereby a slightly-raised, continuous, helical protrusion is formed which mates with the internal helical groove of the outer tube, but does not entirely fill the internal groove, a continuous helical passageway between the inner and outer tubes thereby being formed, said continuous, narrow helical passageway being unimpeded and extending from one end of said double wall tubing to the other end thereof, the inner surface of the outer tube, except in the region of the inner, continuous, small helical groove thereof, contacting the outer surface of the inner tube, except in the region of the slightly-raised continuous helical protrusion thereof.

4. Process as claimed in claim 3 further comprising annealing the inner and outer tubes, after being combined and before the rolling step.

* * * * *